United States Patent [19]

Lackner et al.

[11] Patent Number: 4,947,512

[45] Date of Patent: Aug. 14, 1990

[54] CONVERTIBLE VACUUM CLEANER

[75] Inventors: John R. Lackner, North Ridgeville; Stanley E. Grzywna, Elyria; Ralph A. Weber, Richmond Heights, all of Ohio; Thomas E. Baird, Springfield, Ill.

[73] Assignee: The Scott Fetzer Company, Westlake, Ohio

[21] Appl. No.: 282,116

[22] Filed: Dec. 9, 1988

[51] Int. Cl.[5] ..... A47L 5/12

[52] U.S. Cl. ..... 15/329; 15/410

[58] Field of Search ..... 15/410, 323, 329, 328, 15/344, 347; 55/DIG. 2, DIG. 3, 378; 16/110

[56] References Cited

U.S. PATENT DOCUMENTS

| | | | |
|---|---|---|---|
| 2,044,830 | 6/1936 | Carlstedt | 15/329 X |
| 3,608,333 | 9/1971 | Selley et al. | 15/329 X |
| 3,758,914 | 9/1973 | Nupp et al. | 15/329 X |
| 4,662,026 | 5/1987 | Sumerau et al. | 15/329 |

*Primary Examiner*—Frankie L. Stinson

*Attorney, Agent, or Firm*—Watts, Hoffmann, Fisher & Heinke Co.

[57] ABSTRACT

A convertible vacuum cleaner providing a detachable upright handle permits the vacuum cleaner to be used as an upright cleaner for cleaning rugs, carpets, and the like. A detachable portable hand cleaner handle is also provided which is mounted when the cleaner is to be used as a portable hand cleaner. A resiliently biased, releasable connector is mounted on the filter bag to detachably connect the filter bag to either of the handles. The connector is connected to the upright handle. The connector is resiliently connected to the bag so that the bag remains in proper extended position in all operating positions of the upright handle. A receiver having a socket and a mating blade on the handles permits the two handles to be selectively mounted on the power unit of the cleaner. The portable handle provides a shoulder strap which is retracted into the handle by a reel when not in use and is locked at any selected extended position when the shoulder strap is in use.

16 Claims, 5 Drawing Sheets

CONVERTIBLE VACUUM CLEANER

BACKGROUND OF THE INVENTION

This invention relates generally to vacuum cleaners, and more particularly to a novel and improved vacuum cleaner which can be converted from an upright carpet cleaner to a portable hand cleaner.

PRIOR ART

Typically, an upright vacuum cleaner for cleaning carpets and rugs includes a power unit having a motor-driven fan, and a powered brush roll also driven by the motor through a drive belt. Further, such upright cleaners normally provide an upright handle pivotally connected to the power unit and a dust bag filter system attached at its lower end to the exhaust of the fan and supported at its upper end by the upright handle.

It is also known to provide vacuum cleaners which can be converted from an upright carpet or rug cleaner to a portable hand vacuum cleaner. Such convertible cleaners often provide a detachable mounting for the upright handle and a separate hand cleaner handle which can be detachably mounted on the power unit for the hand cleaner mode of operation.

Further, it is known to detach the end of the dust bag assembly from the upright handle when such handle is removed and to attach such end of the dust bag to the hand cleaner handle for portable hand cleaner operation. Such a convertible vacuum cleaner has been marketed by The Scott Fetzer Company, of Westlake, Ohio, under the trademark "HERITAGE II" system. Also, examples of convertible vacuum cleaners having removable upright handles are described in U.S. Pat. Nos. 3,621,511 and 3,897,607.

SUMMARY OF THE INVENTION

There are several important aspects to the present invention. In accordance with one important aspect of the invention, a novel and improved detachable mounting system is provided for vacuum cleaner handles. Such mounting system provides a very secure, substantially rigid connection which can be easily connected and disconnected, permitting the quick and easy removal and interchange of upright handles and portable handles on the power unit of a vacuum cleaner.

The illustrated embodiment includes a relatively wide, laterally extending blade on each handle, and a receiver on the power unit providing a mating socket. Such socket is sized to closely fit the handle blade. The receiver is pivotally mounted on the power unit so that the upright handle can be moved from a generally vertical position to a generally horizontal position. A spring-biased locking bolt is mounted on the receiver for movement between an extended, locked position and a retracted position. Such lock bolt is centrally mounted in the receiver. The blade provides a centrally located lock bolt opening through which the lock bolt extends when an associated handle is installed to secure the blade in a fixed position within the receiver socket.

Camming surfaces on the blade overcome the spring bias of the lock bolt as the blade enters the receive: to move the lock bolt to its retracted position against the spring bias. When the blade is properly positioned in the receiver socket, the lock bolt opening is in alignment with the lock bolt, which is automatically extended into the locked position by the spring bias. Therefore, the handle is installed and locked in position by merely inserting the blade of the handle into the receiver socket.

The blade extends laterally along the socket a substantial distance, and engages mating surfaces in the receiver socket at substantially spaced locations, providing a connection in which the handle is secured against substantially all movement relative to the power unit in lateral directions. The lock bolt functions primarily to prevent removal of the blade and is not loaded to any material extent by lateral loads applied to the handle.

When the user desires to remove the handle mounted on the power unit, a button is pressed to move the lock bolt against the spring bias to its released position clear of the lock bolt opening in the blade, and the handle is easily lifted to remove the blade of the handle from the receiver. In accordance with this aspect of this invention, a simple, strong, rigid, and detachable handle mounting structure is provided which can be easily connected and disconnected.

In accordance with another important aspect of this invention, a novel and improved connection structure is provided to releasably connect the end of the dust bag remote from the power unit on either the upright handle or the portable hand cleaner handle. Such connection is spring-biased to maintain the dust bag extended as the upright handle is pivoted back and forth during the operation of the cleaner.

A spring is mounted between the connector and the dust bag which moves the connector toward the dust bag when the upright handle is in a position approaching vertical. However, when the handle is tipped down during the use of the cleaner, the spring allows the connector to extend relative to the adjacent end of the dust bag. Therefore, it is not necessary to locate the pivot axis around which the handle moves at the effective pivot of the bag on the power unit. Instead, this spring-biased connector maintains proper bag support even when the handle pivot axis is located a substantial distance from the effective pivot of the connection between the filter bag and the power unit. Consequently, the location of the pivot axis of the handle and the location of the connection of the bag on the power unit can be separately selected for an optimum configuration.

In accordance with this aspect of the invention, a simple connector system is provided for connecting the end of the dust bag remote from the power unit to the handle, and which maintains proper extension of the bag when the handle is pivoted back and forth during use of the cleaner.

In accordance with still another important aspect of this invention, a novel and improved portable hand cleaner handle and shoulder strap combination is provided. The combination handle and shoulder strap is installed when the cleaner is converted for use as a hand cleaner. The shoulder strap is mounted on the handle and the handle provides a reel on which the strap is coiled and stored within the handle when the strap is not in use. When the user wishes to support the power unit from his or her shoulder to leave both hands free to control a hose-connected attachment or the like, the reel is released to extend the strap. A reel stop automatically operates to hold the reel when the desired strap length is released. Therefore, the length of the shoulder strap is easily adjusted to fit the user's requirements.

In the illustrated embodiment, the reel is provided with a pivoted crank to turn the reel and recoil the strap on the reel. When the crank is pivoted to its folded position, it automatically locks the reel.

In accordance with this aspect of the invention, a convenient shoulder strap is stored within the handle and can be easily adjusted to any desired length for convenient use.

These and other aspects of this invention are illustrated in the accompanying drawings, and are more fully described in the following specification.

DETAILED DESCRIPTION OF THE DRAWINGS

Figure 1:
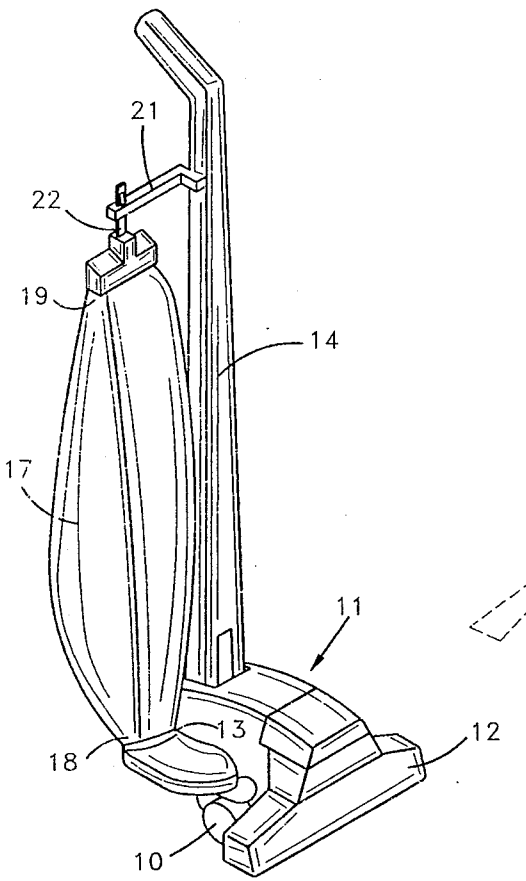
FIG. 1 is a perspective view of a convertible cleaner in accordance with the present invention, with the upright handle attached for operating in the normal mode for cleaning carpets or rugs.

FIG. 1 illustrates a typical convertible vacuum cleaner incorporating the present invention. In FIG. 1, the vacuum cleaner is illustrated in its upright configuration, in which it is normally used to clean carpets or rugs. Generally, cleaners of this configuration are referred to as "upright cleaners" and when the phrase "upright handle" is used, it should be understood that such handle is not necessarily vertical. The vacuum cleaner includes a power unit 11 containing a motor-driven fan which operates to draw dirt-laden air in through a nozzle 12 and to discharge the dirt-laden air through an outlet 13. Although not illustrated, a powered brush roll is journaled within the nozzle and is driven by the power unit motor through a belt drive. Also, the power unit includes wheels 10 which support the power unit 11 for movement along a floor surface.

Connected to the power unit 11 for pivotal movement is an upright handle 14 with which the user moves the vacuum cleaner back and forth along the surface being cleaned. An elongated dust bag 17 is mounted at one end 18 on the outlet 13 of the power unit and is supported at its opposite end 19 by a lateral dust bag support 21 provided by the handle 14.

As discussed in greater detail below, a connector 22 mounted on the upper end 19 of the dust bag releasably connects the end 19 to the support 21. Such connector is mounted on the dust bag 17 for limited movement between a retracted position and an extended position and is spring-biased toward the retracted position.

Figure 2:
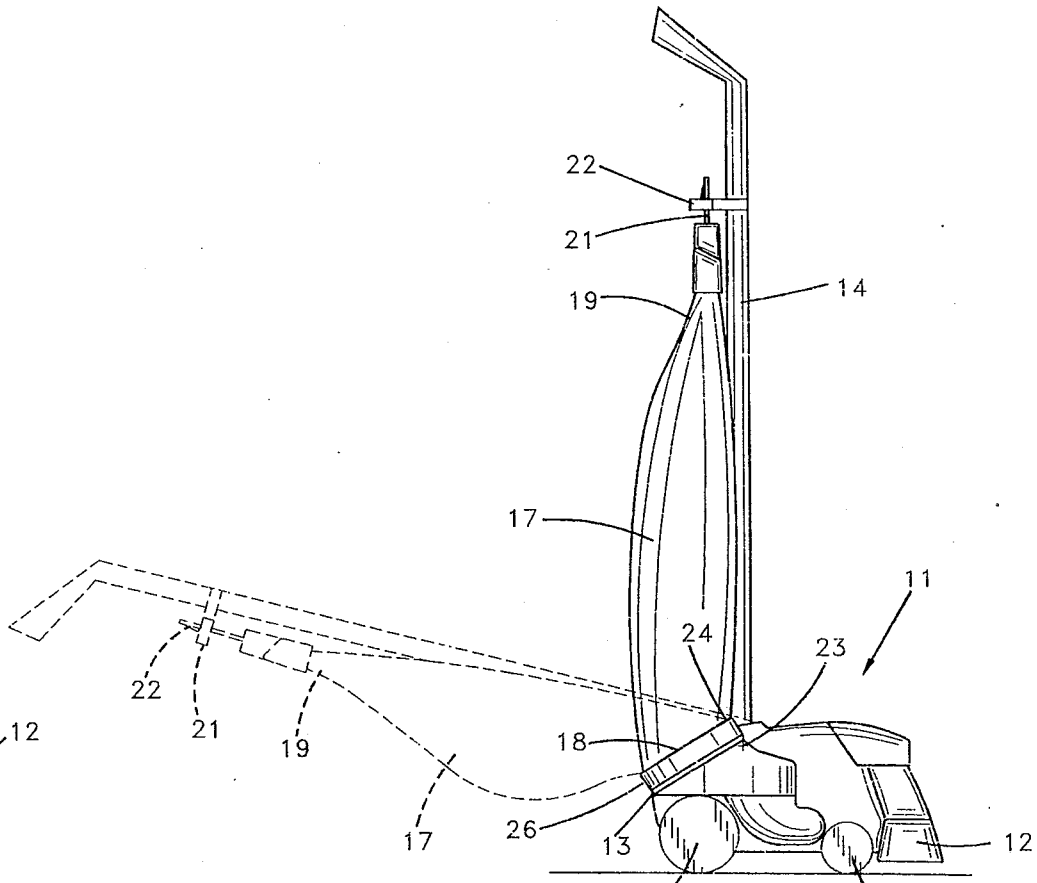
FIG. 2 is a side elevation of the cleaner illustrated in FIG. 1, illustrating in full-line the handle in a substantially vertical position and in phantom line the handle and dust bag in a lowered, substantially horizontal position.

Referring to FIG. 2, the handle 14 is pivotally mounted on the power unit 11 for pivotal movement about a pivot axis 23 between a substantially vertical position, illustrated in full-line in FIG. 2, and a lowered position illustrated in phantom therein. During normal use of the vacuum cleaner as a carpet cleaner, the handle pivots back and forth to positions intermediate the upright position and the lowered position as the cleaner moves back and forth along the surface being cleaned.

The dust bag 17 is formed of a flexible material, such as a fabric, which is porous so that the air discharged into the lower end of the bag 18 can pass out through the pores into the environment. Although the exterior fabric dust bag, which is not disposable in normal use, may be used without an inferior disposable bag normally formed of a porous paper, the illustrated embodiment is typically provided with an internal disposable bag. Such disposable bag is removed through a zipper opening in the cloth bag when it is full and is to be discarded and a new empty bag is installed. For a detailed description of the disposable bag and its mounting within the exterior cloth bag 17, reference should be made to the copending application Ser. No. 208,735, filed June 17, 1988 (assigned to the assignee of the present invention). Such copending applications incorporated herein by reference to provide such disclosure.

When the handle is in the upright position, the spring bias of the connector 22 causes the upper end 19 of the bag to raise up along the connector to maintain the bag in a neat extended position. However, when the fan is turned on, the bag tends to bellow out and become taut, causing the upper end of the bag 19 to move down somewhat toward the outlet 13. With the connector, the bag is free to extend fully under the internal pressure of the air exhausted through the outlet into the bag.

Further, when the handle 14 is tipped down toward the lowered phantom position by pivotal movement around the pivot axis 23, the connector is again moved toward the extended position. The pivot axis 23 does not coincide with the point 24 where the upper or forward edge of the bag 17 is attached to the outlet 13 by a mounting collar 26. The spring bias on the connector 22 operates to hold the bag in an extended position, both when the fan is operating and when it is shut off, by allowing spring-biased movement of the bag relative to the support 21. The copending application Serial No. 249,311, filed Sept. 26, 1988 (also assigned to the assignee of the present invention), illustrates the structural detail of the mounting collar 26 and its attachment to the dust bag 17. Such copending application is incorporated herein by reference to provide such detailed disclosure.

Figure 3A:
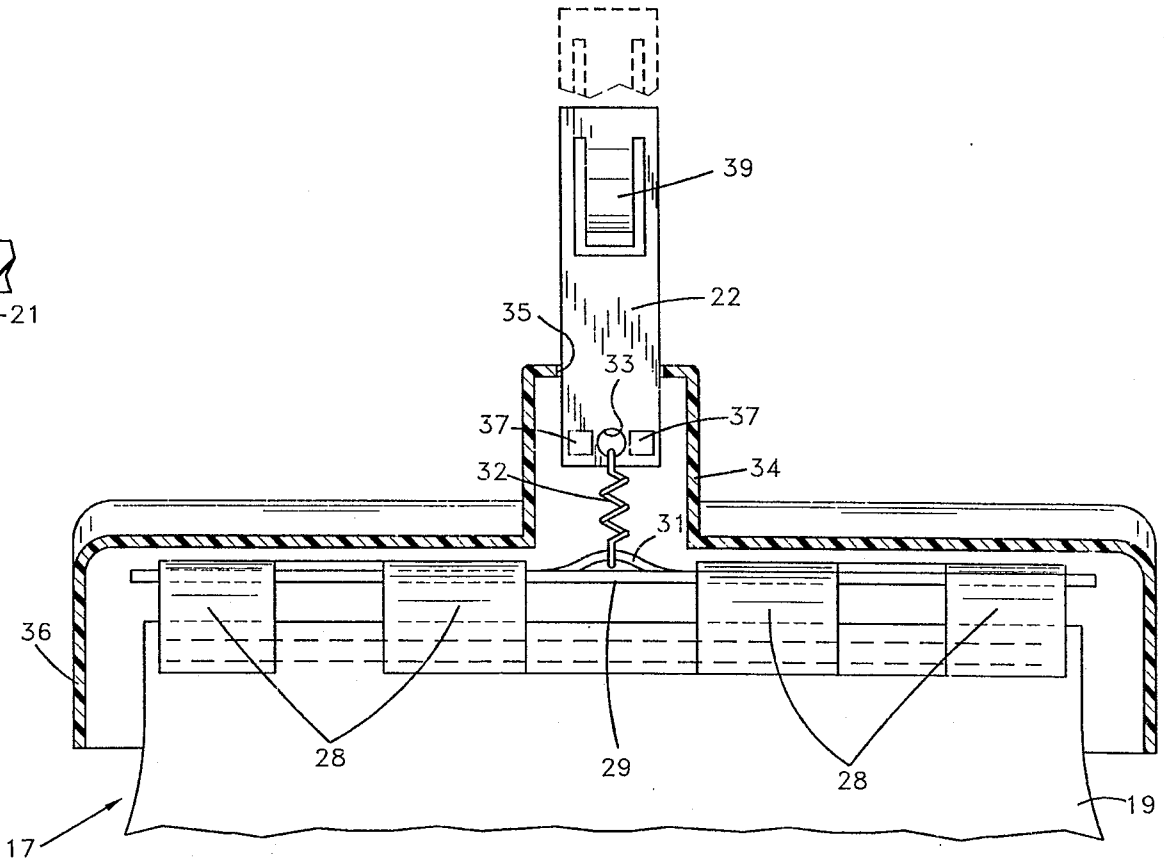
FIG. 3*a* is a front elevation in partial cross section, illustrating the manner in which the connector extends and retracts.
Figure 3:
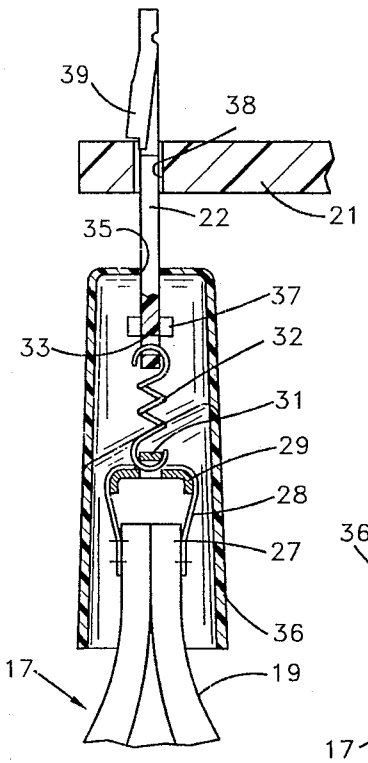
FIG. 3 is a cross section illustrating the spring-biased connector structure for connecting the dust bag and the upright handle.

FIGS. 3 and 3*a* illustrate the structural detail of the connector 22 and its mounting on the upper end 19 of the dust bag 17. Permanently attached to the end 19 of the dust bag 17 by stitching 27 are four cloth loops 28 through which a mounting bar 29 extends. Such mounting bar is preferably formed of metal and provides a centrally located, upstanding strap portion 31 on which the lower end of a coiled spring 32 is mounted. The upper end of the spring 32 extends through an opening 33 formed in the connector 22. The connector extends out through an opening 35 formed in a decorative cover member 34. The cover member 34 provides a skirt 36 which extends inwardly along the upper end of the bag to conceal the attachment of the bag 17 to the connector and to provide a neat, aesthetically desirable appearance.

The connector itself is formed of a resilient material and is preferably molded plastic. Adjacent to the opening 33 are lateral projections 37 which engage the wall of the cover member 34 adjacent to the opening 35 when the collector 22 is extended to the phantom position illustrated in FIG. 3*a*, thereby limiting the extension of the connector relative to the cover member to such extended position. Such extending movement of the connector, however, is resisted by the resilient force of the spring 32, which urges the connector inwardly to the retracted position illustrated in full-line in FIG. 3*a*.

In order to releasably connect the connector 22 to the support 21, the support 21 is provided with a slot opening 38 sized to receive the upper end of the connector 22 with a close fit. Adjacent to the upper end of the connector 22, the connector provides a latch portion 39 which in its unstressed position extends laterally from the plane of the connector 22. The latch portion is deflectable into the plane of the connector 22 to permit insertion of the connector 22 through the slot 38 and for removal therefrom. With this structure, the connector is connected to the support 21 by merely moving the connector 22 longitudinally into the slot, where the latch automatically locks it in its connected position. During such insertion, the latch is deflected inwardly to allow its passage through the opening.

Removal of the connector from the support 21 is accomplished by merely deflecting the latch inwardly into the plane of the connector so that it can pass freely back and out of the opening 38. This support system provides a very simple, reliable, and neat releasable connection for connecting the end 19 of the bag to the support and which conceals the biasing spring 32 and protects it from damage. In use, however, the connector can extend or retract and operates to maintain the bag in a proper extended position under all conditions of use of the cleaner in its upright or carpet-cleaning configuration.

Figure 4A:
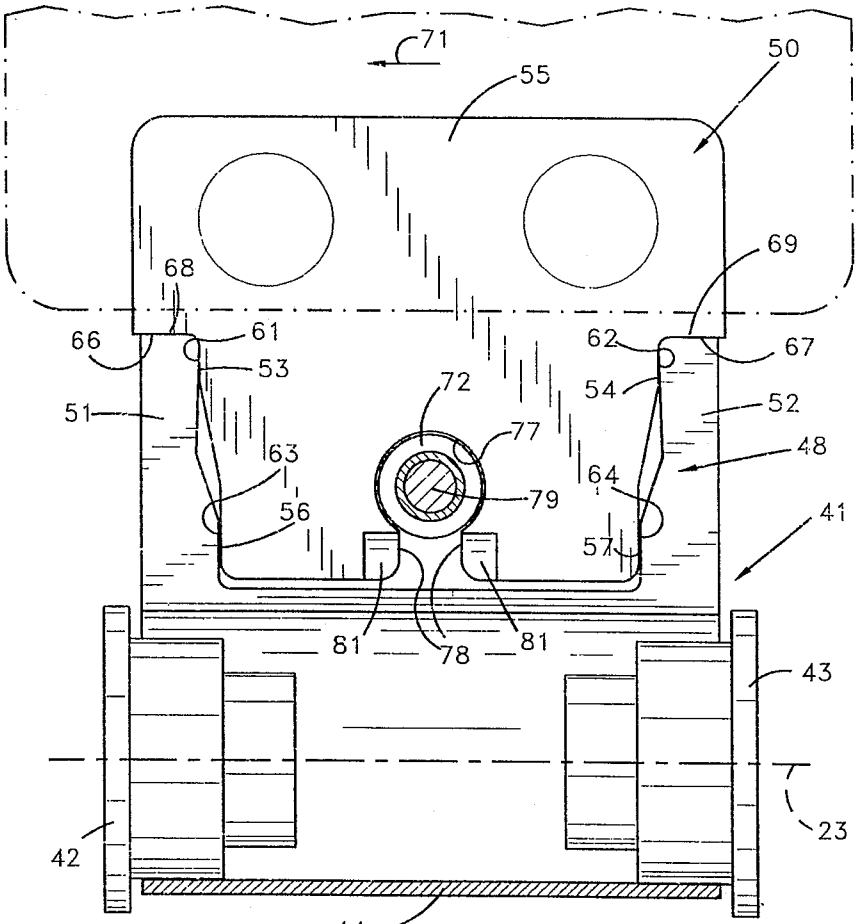
FIG. 4*a* is a cross section taken generally along line 4*a*—4*a* of FIG. 4, illustrating the assembled connection.
Figure 4:
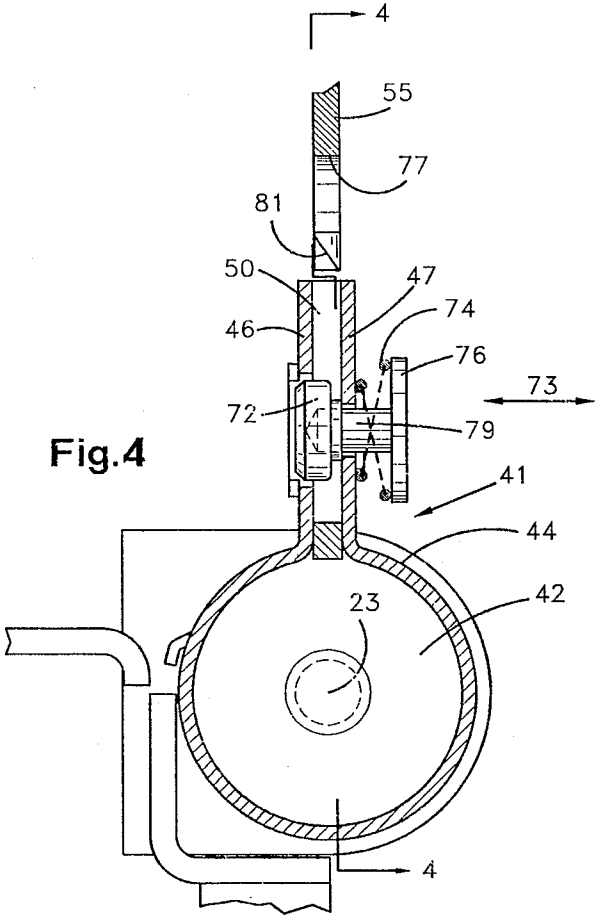
FIG. 4 is a fragmentary cross section of the structure for releasably mounting the handle on the power unit, illustrating the components prior to installation of the handle.
Figure 4B:
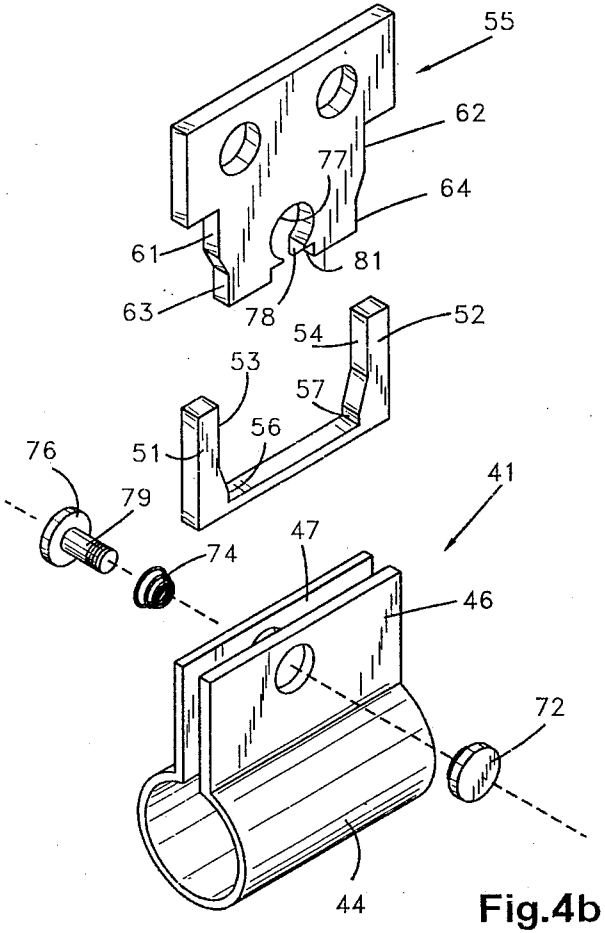
FIG. 4*b* is an exploded, perspective view, illustrating the receiver components and handle mounting blade prior to assembly.

FIGS. 4, 4*a*, and 4*b* illustrate the removable mounting structure for the handle 14. This mounting is structured for ease of installation and removal of the upright handle, and also for a secure connection which provides substantially no lateral looseness or play, either back and forth or from side to side.

Mounted on the power unit 11 (illustrated in FIGS. 1 and 2) is a pivoted receiver assembly 41. Such receiver assembly is mounted on the power unit by pivot members 42 and 43 for pivotal movement about the pivot axis 23, as illustrated in FIG. 2. The receiver includes a strap 44 which extends around the pivot members 42 and 43 and provides spaced and parallel, upstanding end portions 46 and 47. A U-shaped plate 48 is mounted between and connected to the end portions 46 and 47, cooperating therewith to provide a receiver socket 50. The upstanding legs 51 and 52 are similar and opposite, providing opposed side wall surface portions 53 and 54 adjacent to the upper edge of the receiver, and opposed side wall surface portions 56 and 57 adjacent to the lower end of the receiver. A mounting blade 55 formed of metal plate, having a thickness substantially equal to the spacing of the end portions 46 and 47, is shaped and sized to extend into the socket 50 provided by the receiver when the handle is mounted thereon. The blade 55 provides spaced, opposed surfaces 61, 62, 63, and 64, which are spaced apart to respectively mate with the surface portions 53, 54, 56, and 57 when the blade is inserted into the socket of the receiver. The movement into the receiver socket of the blade is limited by lateral surfaces 66 and 67, which engage the ends 68 and 69, respectively, of the legs 51 and 52.

Since the mating laterally facing surfaces are substantially spaced apart, and since the depth of the blade and the socket provides a substantial spacing between the mating lateral surfaces, the blade is strongly supported in the plane of the blade. Consequently, the blade and the handle mounted thereon are firmly supported against any appreciable side movement in a lateral direction. For example, if the handle were subjected to a force in the direction of the arrow 71, illustrated in FIG. 4*a*, the coaction of the mating surfaces 53 and 61 and the mating surfaces 57 and 64 provides a strong opposing force couple resisting any movement of the handle in the direction of the arrow 71. A similar action occurs resisting movement produced by a force in a direction opposite to the arrow 71. The blade and the U-shaped plate member are sized to provide sufficient clearance so that the blade can be easily installed or removed from the receiver, but a sufficiently close fit is provided to prevent any material looseness in the connection.

A similar situation exists with respect to any forward or rearward lateral force applied to the handle, since the blade 55 has substantial depth and closely fits between the two end portions 46 and 47. A strong connection is provided between the receiver and the blade of the handle which does not introduce any material looseness in the connection. Further, the rectangular cross section of the blade and socket prevents rotation of the handle relative to the power unit.

In order to lock the blade in the installed position, a lock bolt 72 is mounted within the two end portions 47 for movement in the direction of the arrow 73 between an extended or locked position, illustrated in FIG. 4, and a released position to the left of the locked position, as viewed in FIG. 4. The lock bolt is biased toward its locked position illustrated by a spring 74 positioned between the end portion 47 and a head or button portion 76 mounted on the lock bolt.

The blade 55 is provided with an opening 77 sized to closely fit the lock bolt when the blade is installed so that the blade is locked in the installed position in normal use of the vacuum cleaner. The lower side of the opening 77 is opened through a slot 78 sized to clear a stem portion 79 of the lock bolt during insertion and removal of the blade 55. Further, a pair of inclined camming surfaces 81 are provided on the blade to cam the lock bolt 72 from its locked position as the blade is installed. When it is desired to remove the blade from its installed position, the user merely presses against the head portion 76 to release the lock bolt and the blade is then free for upward removal from the receiver. The width of the blade 55 at its end is less than the width of the socket 50 at its entrance to facilitate installation of the handle.

Figure 5:
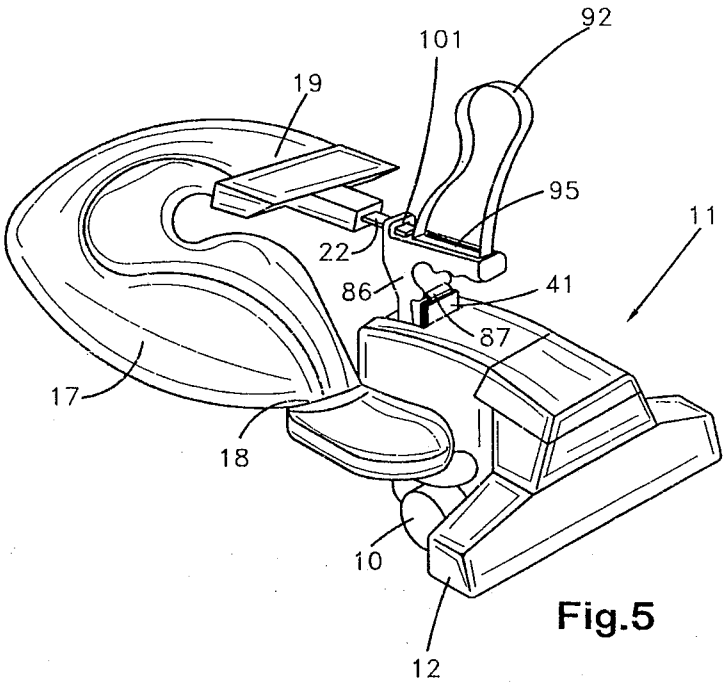
FIG. 5 is a perspective view, similar to FIG. 1, but illustrating the cleaner with the portable handle installed for operation of the cleaner in a portable configuration.

FIG. 5 illustrates the vacuum cleaner in a configuration for use as a hand or portable cleaner. In such configuration, the connector 22 at the upper end of the bag 17 is removed from the support 21 and the upright handle 14 is removed, as discussed above. In the place of the upright handle 14, a portable handle assembly 86 is then installed. Such handle provides a blade 87 having the same size and shape as the blade 55 of the handle 14, which fits into and locks within the receiver assembly 41 in the same manner as the blade of the upright handle.

Figure 6A:
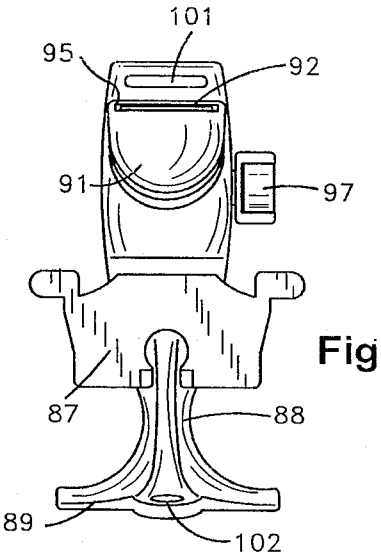
FIG. 6*a* is an end view of the portable handle of FIG. 6.
Figure 6B:
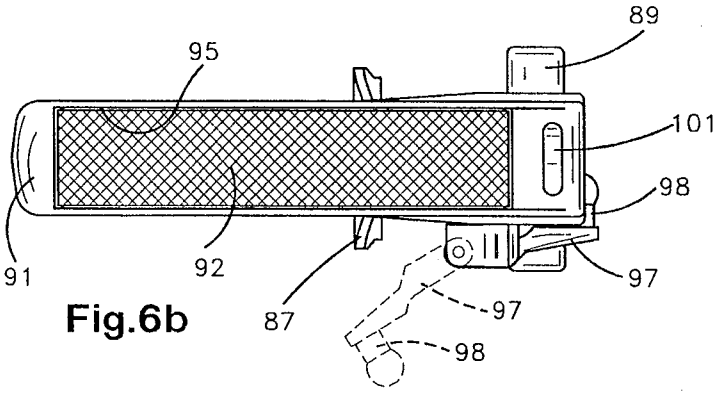
FIG. 6*b* is a plan view of the portable handle of FIG. 6.
Figure 6:
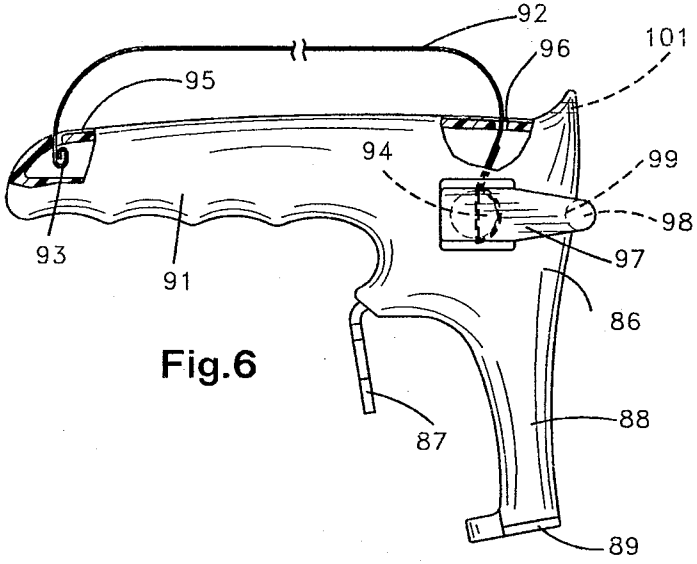
FIG. 6 is an enlarged side elevation of the portable handle and strap assembly which allows the shoulder strap to be extended or stored within the handle itself.

The portable handle 86 has a shape illustrated in detail in FIGS. 6 through **6*b*, and provides a leg 88 spaced back from the blade 87 providing a foot 89 which engages a mating surface provided by the housing of the power unit to cooperate with the blade and stabilize the portable handle in a fixed position. This leg 88 and foot 89** are sized and proportioned to hold the receiver in its most upright pivotal position so that the portable handle cannot pivot back and forth when installed.

The portable handle also provides a gripping portion 91 with which the vacuum cleaner can be held and moved for a portable vacuum cleaner operation.

In some instances, it is desirable to use a shoulder strap to support the cleaner from the user's shoulder, leaving both hands free to control and move a hose attachment or the like connected to the vacuum cleaner. The portable handle is therefore provided with a shoulder strap 92 anchored at one end 93 in the handle and at its other end on a roller or reel 94 pivoted in the handle. The strap 92 extends into the interior of the handle through an opening 96 and is wrapped around the reel 94.

When use of the shoulder strap is not required, a crank 97 pivotally mounted on the end of the roller 94 is operated to roll the strap onto the roller so that the strap lies flush against the top surface of the handle. The top surface of gripping portion 91 is recessed to provide a channel 95 which receives the shoulder strap when it is not in use.

The crank 97 is provided with a handle portion 98 which fits into a notch 99 formed in the handle to lock the roller 94 against rotation. However, when it is desired to extend or retract the shoulder strap, the crank is pivoted out of the notch 99 to allow rotation of the roller to either extend or retract the strap. When the user desires to extend the strap 92, the handle is pivoted to a release position and the strap is pulled out to any desired length. The handle is then pivoted into the locked position of FIG. 6, and the length of the strap is established. When the use of a shoulder strap is not required, the crank 97 is pivoted out and the user merely winds the strap onto the roller until it lies flat along the upper side of the handle within the channel 95, where it does not interfere in any way with the usual use of the hand cleaner handle to support or move the cleaner.

With this structure, a shoulder strap can be adjusted to any desired length and is conveniently stored when not used within the handle. Therefore, the user does not have to attach or remove a separate shoulder strap, and it is always available for use when needed.

When the portable handle 86 is installed, the connector 22 is pressed into a slot 101 formed in the rearward end of the handle so that the bag is held in a relatively compact manner for convenient use of the vacuum cleaner. Such slot is sized and shaped similar to the slot in the support 21 of the upright handle, and the connector is installed and removed therefrom in the same manner that it is installed and removed on the upright handle.

The foot 89 of the portable handle is provided with an opening 102 which fits over an upstanding lug on the housing of the power unit to provide further stabilization of the portable handle when it is mounted on the vacuum cleaner.

Although the preferred embodiment of this invention has been shown and described, it should be understood that various modifications and rearrangements of the parts may be resorted to without departing from the scope of the invention as disclosed and claimed herein.

What is claimed is:

1. A convertible vacuum cleaner comprising a power unit operable to draw in dirt-laden air and provide an outlet through which said dirt-laden air is exhausted, a handle receiver pivoted on said power unit, an upright handle removably mounted on said receiver for pivotal movement relative to said power unit with said receiver, a dust bag mounted at one location on said outlet and detachably mounted on said handle at another location, said handle and receiver cooperating to provide an elongated socket and a mating elongated mounting portion structured to extend into said socket with a close fit to detachably connect said handle to said receiver, said mounting portion and said socket providing spaced mating surfaces preventing any substantial lateral movement of said handle relative to said receiver when said mounting portion is positioned in said socket.

2. A vacuum cleaner as set forth in claim 1, wherein said mounting portion is insertable into and removable from said socket by relative movement therebetween in a predetermined direction, and releasable lock means are provided to prevent relative movement in said predetermined direction.

3. A vacuum cleaner as set forth in claim 2, wherein said socket has a substantially rectangular cross section providing spaced opposed internal wall portions, and said mounting portion has a substantially rectangular cross section and provides spaced opposed external surfaces structured to mate with associated wall portions and substantially prevent relative movement of said mounting portion relative to said receiver when said mounting portion is in said socket.

4. A vacuum cleaner as set forth in claim 2, wherein said lock means includes a lock bolt mounted for movement in a direction substantially perpendicular to said predetermined direction between a locked position and a release position, said lock bolt being spring-biased toward said locked position in which it prevents relative movement between said socket and said mounting portion in said predetermined direction.

5. A vacuum cleaner as set forth in claim 4, wherein cam means are provided to cam said lock bolt to said release position as said blade moves into said socket

6. A vacuum cleaner as set forth in claim 5, wherein said cam means are provided on said mounting portion and said lock bolt is mounted in said socket.

7. A vacuum cleaner as set forth in claim 4, wherein said lock bolt provides user-accessible means to permit a user to move said lock bolt to said release position for removing said mounting portion from said socket.

8. A vacuum cleaner as set forth in claim 7, wherein said receiver provides said socket and said handle provides a mounting portion.

9. A vacuum cleaner as set forth in claim 6, wherein said vacuum cleaner is a convertible vacuum cleaner, said vacuum cleaner including a portable handle having a mating portion substantially identical to said mounting portion of said upright handle.

10. A vacuum cleaner as set forth in claim 9, wherein said portable handle includes stabilizing means to prevent pivotal movement of said receiver when said portable handle is installed.

11. A vacuum cleaner as set forth in claim 10, wherein said stabilizing means includes a surface spaced from said receiver engaging said power unit.

12. A vacuum cleaner as set forth in claim 9, wherein said portable handle includes a shoulder strap, and storage means for storing said shoulder strap within said handle when said shoulder strap is not in use.

13. A vacuum cleaner as set forth in claim 12, wherein said storage means includes a reel journaled in said portable handle around which said shoulder strap is coiled when said shoulder strap is not in use.

14. A vacuum cleaner as set forth in claim 13, wherein a crank is connected to said reel for extending and retracting said shoulder strap.

15. A vacuum cleaner as set forth in claim 14, wherein said crank is movable to a locked position to lock said reel when said shoulder strap is extended a desired amount.

16. A vacuum cleaner as set forth in claim 9, wherein said bag provides a connector mounted on said bag for movement relative thereto between a retracted and an extended position, said connector being spring-biased to said retracted position, said connector being detachably connectable on both said upright handle and said portable handle.

* * * * *